US005958278A

United States Patent [19]

Engebritson et al.

[11] Patent Number: 5,958,278

[45] Date of Patent: Sep. 28, 1999

[54] MICROWAVE OVEN HAVING AN ORTHOGONAL ELECTROMAGNETIC SEAL

[75] Inventors: Larry M. Engebritson, Cedar Rapids; Thomas L. Miller, Wellman, both of Iowa; Richard H. Edgar, Chelmsford, Mass.

[73] Assignee: Amana Company, L.P., Houston, Tex.

[21] Appl. No.: 08/929,192

[22] Filed: Sep. 8, 1997

[51] Int. Cl.[6] ..... B65D 25/00

[52] U.S. Cl. ..... 219/741

[58] Field of Search ..... 219/739–743; 174/35 R, 35 G, 35 MS

[56] References Cited

U.S. PATENT DOCUMENTS

| | | | |
|---|---|---|---|
| 3,666,904 | 5/1972 | Krajewski et al. | 219/739 |
| 3,767,884 | 10/1973 | Osepchuk et al. | 219/742 |
| 4,137,441 | 1/1979 | Bucksbaum et al. | 219/741 |
| 4,176,268 | 11/1979 | Gerling . | |
| 4,421,968 | 12/1983 | Osepchuk | 219/10.55 F |
| 4,709,129 | 11/1987 | Osepchuk | 219/10.55 B |
| 5,789,724 | 8/1998 | Lerssen et al. . | |

FOREIGN PATENT DOCUMENTS 2223931 10/1974 France .

OTHER PUBLICATIONS

VanKoughnett, A. L., et al., "*Doubly Corrugated Chokes For Microwave Heating Systems*," Journal Of Microwave Power, 8(1), 1973, pp. 101–110.

*Primary Examiner*—Teresa Walberg
*Assistant Examiner*—Jeffrey Pwu
*Attorney, Agent, or Firm*—Tobor & Goldstein, LLP

[57] ABSTRACT

An orthogonal electromagnetic seal for an oven that heats items through the use of microwave energy is set forth. The oven has a cavity in which the items are to be placed, an opening to the cavity, and peripheral surfaces that surround the opening to the cavity. One of the peripheral surfaces is orthogonal to the other peripheral surfaces. The electromagnetic seal includes a choke panel, a plurality of tabs, and a choke ring. The choke panel is aligned with and has generally the same shape as the opening. The plurality of tabs extend from a periphery of the choke panel. A first set of the plurality of tabs is generally parallel to the orthogonal peripheral surface. The remaining tabs are parallel with the other peripheral surfaces. Each of the plurality of tabs is positioned between the associated peripheral surface and the choke ring. A choke cavity adjacent to each peripheral surface is defined by the choke ring, the choke panel, and the adjacent peripheral surface. The choke cavity reflects energy propagating in a direction parallel to the adjacent one of the peripheral surface and suppressing energy propagating in a direction transverse to the adjacent one of the peripheral surfaces.

38 Claims, 8 Drawing Sheets

MICROWAVE OVEN HAVING AN ORTHOGONAL ELECTROMAGNETIC SEAL

FIELD OF THE INVENTION

This invention relates generally to microwave ovens which have a seal around the door to inhibit the release of electromagnetic energy from the cavity of the oven. More particularly, the present invention relates to microwave ovens having a conveyer belt passing through the oven cavity which prevents the door from completely closing and a seal that prevents leakage from the oven cavity in the region of the conveyer.

BACKGROUND OF THE INVENTION

Microwave ovens have been used to heat products for several decades. In their basic configuration, the microwave oven includes a magnetron which produces energy with a wavelength generally between 1 cm and 100 cm. In microwave ovens, the energy sent to the oven cavity preferably resonates in a plurality of modes that can be achieved by varying the dimensions of the oven cavity. These resonant modes cause the item to be heated by the rotation of the polar molecules (e.g. water) within the item. The absorption of the energy varies depending on the characteristics of the item as well as its size and shape. To ensure the uniformity of heating, it is desirable to vary the mode pattern with respect to the article by, for example, a mechanical mode stirrer which reflects the energy in different directions, by moving the item within the oven while the oven is operating, or by combinations of these two methods.

The internal cavity of the microwave oven is bounded by conductive side walls that confine the energy to the internal cavity. A door is included on one of the walls to provide access to the internal cavity of the microwave. Because of the door, several seams exist around the periphery of the door where the door meets the side wall. The plurality of electromagnetic modes within the oven can result in the propagation of energy having directional components along the seams which can produce undesirably large amounts of energy leakage through the seams. To alleviate this problem of leakage at the seams, seal devices have been developed to suppress the leakage of the electromagnetic energy. In fact, it would be difficult, if not impossible, for microwave ovens to obtain regulatory approval if an electromagnetic seal was not incorporated at these seams.

On basic household and commercial microwave ovens, the rectangular opening to the internal cavity is bounded by four flat walls which lie in the same plane as the opening. This can be visualized by having a rectangular side wall of the microwave oven with a smaller rectangular cut-out therein which provides an opening to the cavity. The portions of the side wall that surround the cut-out are these four flat side walls bounding the rectangular opening. The generally planar internal surface of the door is disposed in close proximity to those four walls when the door is in the closed position. The seams through which the electromagnetic energy can leak are defined by the internal surface of the door and the four flat walls against which the internal surface is positioned.

One basic way of suppressing the leakage of the electromagnetic energy uses an electromagnetic choke that is placed within the door. The choke includes a metallic panel that has a plurality of tabs or fingers which extend from the panel. The tabs are generally parallel to the seams defined by the flat walls of the oven and the door. The choke also includes a metallic structure, often referred to as a choke ring, positioned away from the tabs. The choke panel, choke ring, and the associated flat wall define a choke cavity which reflects energy propagating in a first direction back into the oven cavity and suppresses energy propagating in a second direction that is perpendicular to the first direction. Thus, the amount of electromagnetic energy that leaks from the oven is minimized. Such an electromagnetic choke is described in U.S. Pat. No. 3,767,884 to Osepchuk, assigned to the assignee of the present application, which is herein incorporated by reference in its entirety.

The frequency of energy that the choke cavity suppresses and reflects depends on the tab width, the tab spacing, the material of the tabs, and the overall dimension of the choke cavity. Thus, varying the physical characteristics of the choke panel and choke ring varies the frequency at which the choke will be effective. Consequently, the choke can be designed to act as an electromagnetic seal for the frequency at which the microwave oven is operating.

However, not all microwave ovens have seams that extend in the same plane as, or in a plane parallel to, the plane in which the opening to the oven cavity lies. A microwave oven may have a door which slides downwardly against a lower planar surface as opposed to a door that pivots around hinges. This may be the case if the microwave oven is automated and has a conveyer belt running therethrough for delivering the items that need to be heated to the internal cavity. When the seams around the door are not in the same plane, a standard planar choke panel cannot be used to suppress the leakage of the electromagnetic energy.

The effectiveness of a planar electromagnetic choke was believed to be reduced if its shape was deformed. One reason for this belief was that deformation of the planar electromagnetic choke creates additional reflective surfaces which would be transverse to the direction of propagation of energy that was to be suppressed. In other words, deforming the choke panel and the choke ring of a standard planar choke was believed to cause more resonation of the energy propagating in the direction that was supposed to be suppressed which leads to more leakage.

Accordingly, in many industrial microwave ovens where a conveyer carries the items into the oven cavity, the sealing of the oven cavity is provided by a suppression tunnel. The suppression tunnel is, in essence, a tunnel of conductive material that projects outwardly from the opening for a distance of several feet. Thus, one can look down along the length of the tunnel and see the oven cavity where the items are being heated; no structures inhibit such a viewing. The tunnel includes various structures (e.g. pins, corrugations, etc.) that attenuate the energy as it moves along the length of the tunnel. One problem with suppression tunnels is that they require much more space since the tunnels extend away from the microwave oven often for up to three or four feet. Another problem is that the opening to the oven cavity must be relatively small for the suppression cavity to be effective. Lastly, the suppression tunnel may be useful for industrial microwaves but cannot be used in commercial ovens since most regulatory agencies will not approve a commercial microwave oven that allows the operator to have a line of sight directly into the oven cavity.

Therefore, a need exists for an effective electromagnetic seal that allows for the sealing of a microwave oven which has seams that lie in different planes, as is the case for a microwave oven that operates on a conveyer system.

SUMMARY OF THE INVENTION

The present invention provides an electromagnetic seal for a microwave oven that has seams that do not lie in the same plane due to the fact that at least one of the peripheral surfaces defining the opening is in a different plane than the remaining peripheral surfaces. Typically, this angled peripheral surface is simply orthogonal to the other peripheral surfaces.

The electromagnetic seal comprises a choke panel having a base portion that is aligned with and has generally the same shape as the opening of the cavity. A plurality of tabs extends from the edges of the panel just as in the standard choke. Each of the tabs is approximately parallel with the peripheral oven surfaces which define the opening to the oven. Thus, one set of tabs is generally at an angle with the remaining tabs because it is parallel to the orthogonal peripheral surface.

A choke ring circumscribes the edges of the base portion of the choke panel and has generally an L-shape cross-section in the region adjacent to the orthogonal peripheral surface and a C-shape cross-section in regions adjacent to the other peripheral surfaces. The sets of tabs are positioned between the choke ring and the peripheral surfaces.

A choke cavity is adjacent to each of the peripheral surfaces since each has a seam which could be a source for electromagnetic leakage. Each of the choke cavities is defined by the choke panel, the choke ring, and the adjacent peripheral surface. The choke cavity reflects one directional component of the microwave energy from a reflective surface within the choke cavity and suppresses another directional component of the microwave energy. The reflective surface for the choke cavity associated with the orthogonal peripheral surface is a region of the base portion of the choke panel. However, the reflective surfaces for the choke cavities associated with the other peripheral surfaces are located on the choke ring.

In contrast to existing planar art choke assemblies which have a symmetrical geometry around the opening, the structure of the present choke assembly has been bent on one side to provide for sealing of the orthogonal peripheral surface. Although the bending of the choke produces an unusual geometry at the region of the bend, the bending of the choke assembly components unexpectedly does not have a detrimental effect on the suppression of the energy. In other words, the geometry of the present invention choke assembly is asymmetrical but results in a desirable electromagnetic sealing around the opening. Unlike the standard planar symmetrical choke assembly, the choke assembly of the present invention inhibits electromagnetic leakage from the oven by reflecting three different components of energy. One component (e.g. X-direction) of the energy propagating adjacent to the orthogonal peripheral surface is reflected back into the oven cavity. A different component (e.g. Z-direction) of the energy at the peripheral surfaces adjacent the orthogonal peripheral surface is reflected back into the oven cavity. And, a third component (e.g. Y-direction) of the energy propagating adjacent to the peripheral surface opposing the orthogonal peripheral surface is reflected back into the oven cavity.

BRIEF DESCRIPTION OF THE DRAWINGS

Other objects and advantages of the invention will become apparent upon reading the following detailed description and upon reference to the drawings in which.

Figure 1:
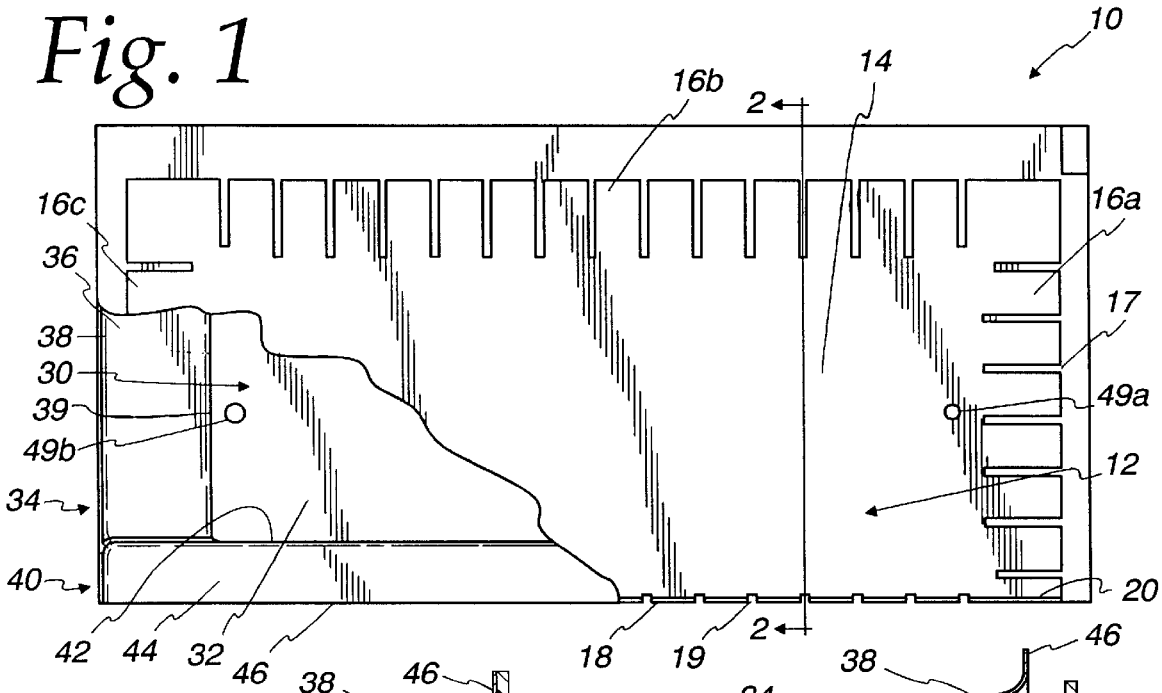
FIG. 1 is a front view of the electromagnetic choke of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed. On the contrary, the intention is to cover all modifications, equivalents, and alternatives falling within the spirit and scope of the invention as defined by the appended claims.

DETAILED DESCRIPTION OF THE INVENTION

Figure 2A:
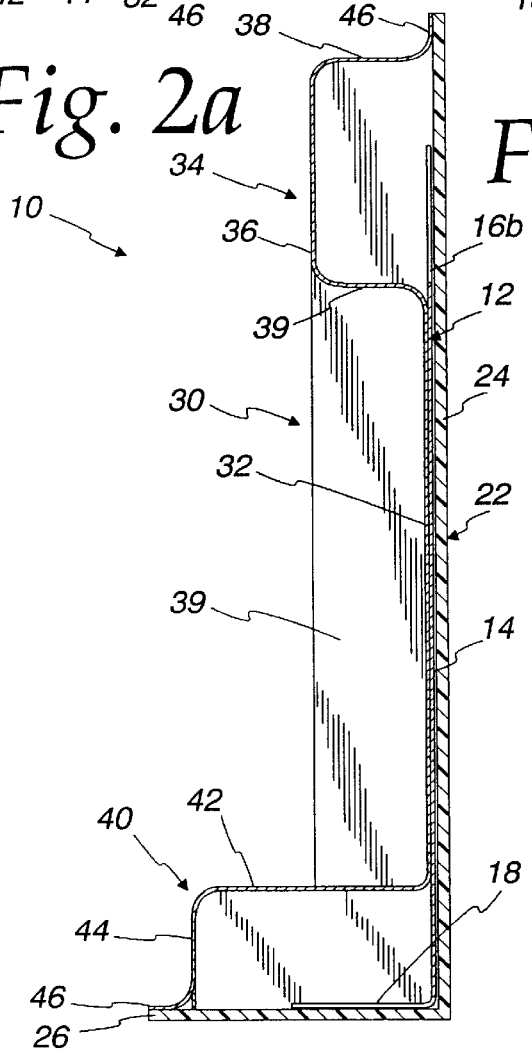
FIG. 2A is a side view of the electromagnetic choke.
Figure 2B:
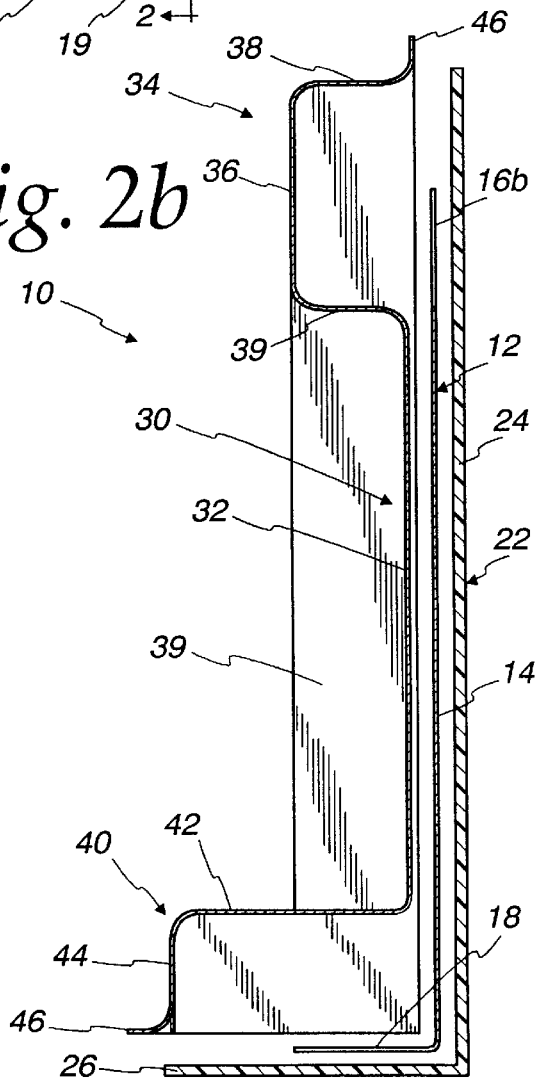
FIG. 2B is an exploded side view of the electromagnetic choke.

Referring initially to FIGS. 1, 2A, and 2B, a choke assembly 10 is illustrated. FIGS. 2A and 2B are taken along line 2—2 within FIG. 1, with FIG. 2B being an exploded view of the components. The choke assembly 10 includes a metallic choke panel 12 that has a base portion 14 which is generally the shape of an opening to a microwave oven. The base portion 14, as shown in FIG. 1, is rectangular which is the most common shape for an opening to a microwave oven. A plurality of tabs 16 extend outwardly from three of the four edges of the rectangular base portion 14. The plurality of tabs 16 are shown in the same plane as the base portion 14 of the choke panel 12, although they can be angled slightly with respect to the base portion 14. A tab space 17 separates adjacent ones of the plurality of tabs 16. As shown in the FIG. 1, the plurality of tabs 16 can be subdivided into three sets of tabs 16*a*, 16*b*, and 16*c* which are attached to respective ones of the edges of the generally rectangular base portion 14.

On the other of the four edges of the base portion 14, a set of orthogonal tabs 18 projects outwardly away from the base portion 14. This set of tabs 18 is approximately perpendicular (i.e. orthogonal) to the base portion 14 of the choke panel 12. Like the plurality of tabs 16 on the other three edges, adjacent ones of the set of orthogonal tabs 18 are separated by a tab space 19. Corner tabs 20 are located where the sets of tabs 16*a* and 16*c* meet the orthogonal tabs 18. As shown best in FIG. 3A, these two corner tabs 20 have portions parallel with the sets of tabs 16*a* and 16*c* and portions which are parallel with orthogonal tabs 18.

A choke cover 22 is positioned behind the choke panel 12. The choke cover 22 is made from a material that is transparent to the electromagnetic energy that is circulating within the cavity of the oven. Often, the choke cover 22 is made of a polymeric material such as polypropylene. The choke cover 22 has a main segment 24 which is generally the shape of the exterior surface of the oven where the opening to the oven resides. Thus, the main segment 24 of the choke cover 22 is larger in area than the base portion 14 of the choke panel 12. Attached to the main segment 24 is an orthogonal segment 26 of the choke cover 22. The orthogonal segment 26 of the choke cover 22 is approximately parallel to the orthogonal tabs 18 of the choke panel 12.

A choke ring 30 is disposed on the side of the choke panel 12 opposite the choke cover 22. The choke ring 30 is made of a conductive material and is connected to the choke panel 12 usually by a weld connection. Of course, other methods of forming an electrical connection can be used. The choke ring 30 has a middle section 32 which is in a plane that is parallel to the base portion 14 of the choke panel 12 and the main segment 24 of the choke cover 22. The middle section 32 is approximately the same shape as the opening for the oven cavity which, as stated previously, is rectangular in this case. A main ring section 34 is attached to the three edges of the middle section 32 adjacent to the three sets of tabs 16*a,* 16*b,* and 16*c* (seen best in FIGS. 3A and 3B). The main ring section 34 has a C-shaped cross-section that is defined by a front wall 36 that is roughly parallel with the tabs 16, an outer side wall 38, and an inner side wall 39. The outer and inner side walls 38 and 39 are spaced by a distance that is at least large enough to allow the tabs 16 to reside within the main ring section 34. Because the main ring section 34 extends around three edges of the choke panel 12, the front wall 36 adjacent to each set of tabs 16*a,* 16*b* and 16*c* lies in one plane. But, each of the outer and inner side walls 38 and 39 has three segments each of which is associated with a respective one of the sets of tabs 16*a,* 16*b,* and 16*c*. These three segments lie in three different planes.

On the fourth edge of the middle section 32 of the choke ring 30 is an orthogonal ring section 40. The orthogonal ring section 40 has an L-shaped cross-section which is defined by a first wall 42 that is roughly parallel to the orthogonal tabs 18 and a second wall 44 that is approximately perpendicular to the orthogonal tabs 18. As best seen in FIG. 1, the front wall 36 of the main ring section 34 meets the first wall 42 of the orthogonal ring section 40 adjacent to the lower ones of the sets of tabs 16*a* and 16*c*.

In one embodiment, the base portion 14 has a series of perforations through which electromagnetic leakage is negligible. The middle section 32 is made of an optically transparent material. Thus, the operator can then see through these structures into the oven cavity.

The choke ring 30 is connected to the choke cover 22 at the periphery of the choke ring 30 where a choke ring flange 46 is located. The choke ring flange 46 rests against the peripheries of the orthogonal segment 26 and main segment 24 of the choke cover 22. Consequently, the choke panel 12 is completely enclosed by the choke cover 22 and the choke ring 30.

The choke panel 12 and choke ring 30 are mechanically linked together. For example, these two pieces may be welded. Holes 49*a* on the choke panel 12 and corresponding holes 49*b* on the choke ring 30 are used for alignment purposes when welding occurs. These holes 49*a,* 49*b* are small and would not provide a path for electromagnetic leakage to ensure against leakage. These holes 49*a* and 49*b* may, however, be filled. In one embodiment, the choke panel 12 is spot-welded to the choke ring 30 on about 0.6 inch spaces. Additionally, the choke panel 12 and the choke ring 30 can be attached by other means such as fasteners.

The choke cover 22 is held fixedly with respect to the choke ring 30. This can be accomplished through fasteners which are positioned near the choke ring flange 46. Alternatively, a clip which holds the flange 46 to the choke cover 22 is possible. In yet another alternative embodiment, the choke assembly 10 may further include a housing 10 which holds the choke cover 22 and the choke ring 30 together (see FIG. 7A).

Figure 3A:
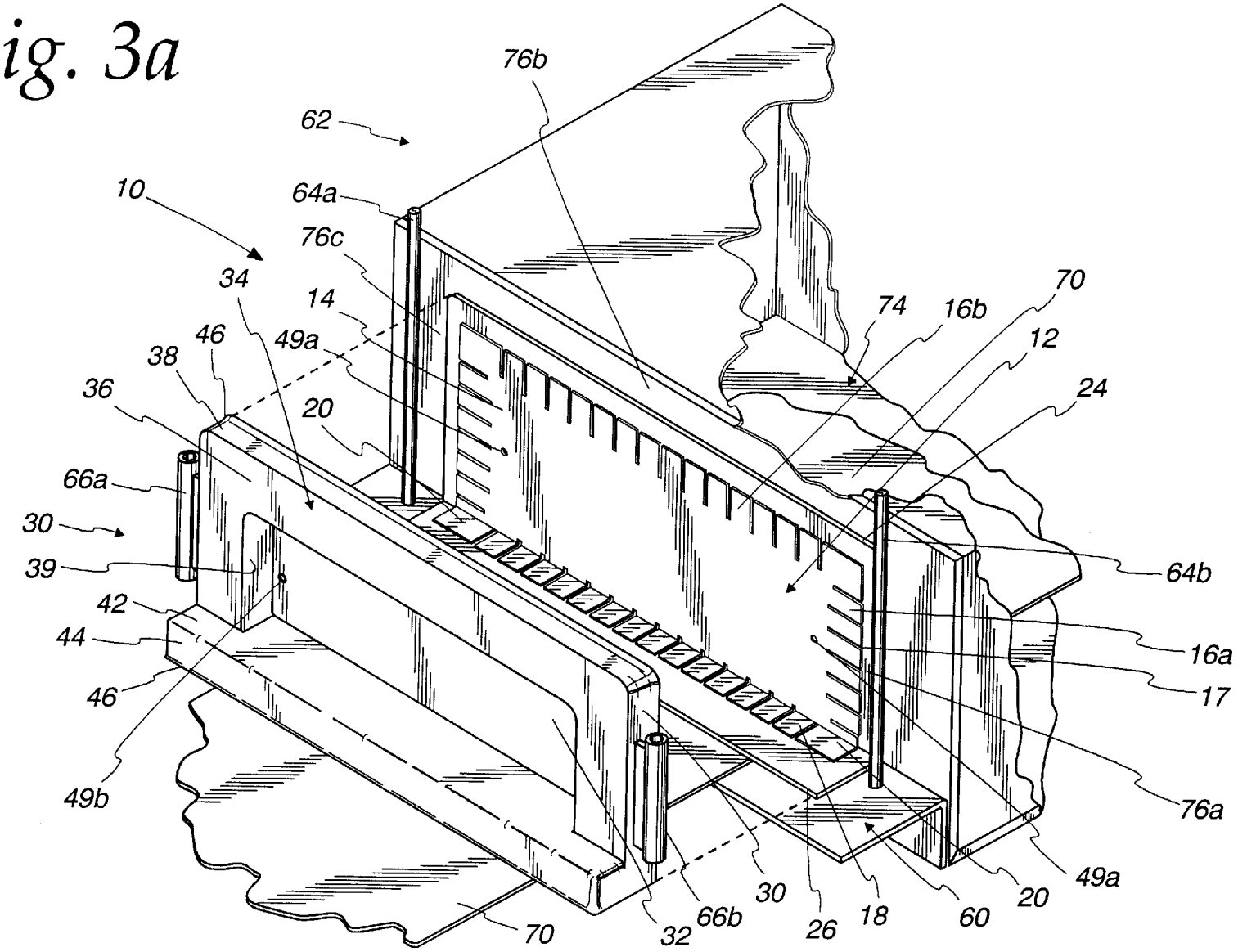
FIG. 3A is an isometric view of the electromagnetic choke on the oven with the door in the closed position.
Figure 3B:
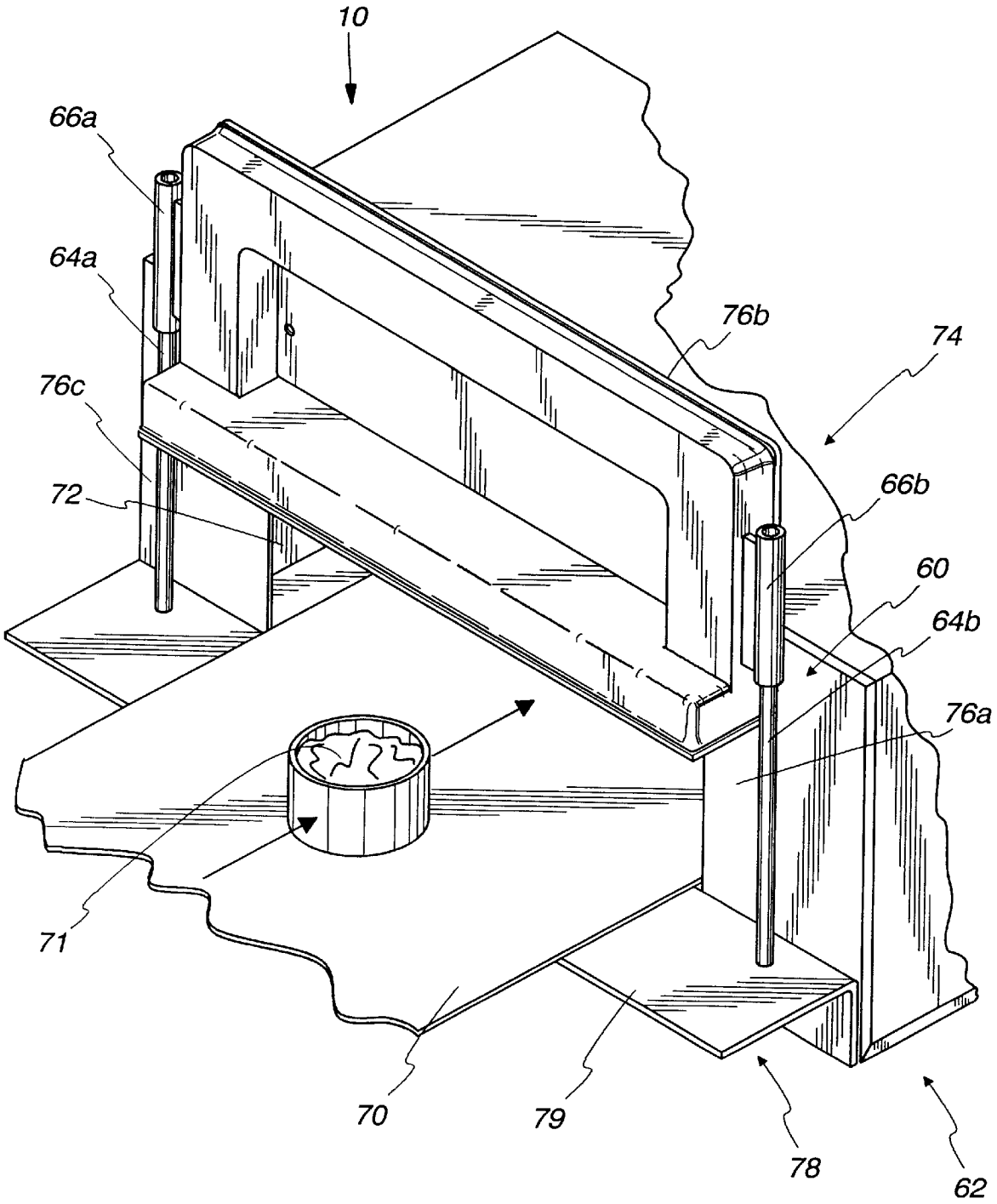
FIG. 3B is an isometric view of the electromagnetic choke on the oven with the door in the opened position.
Figure 4:
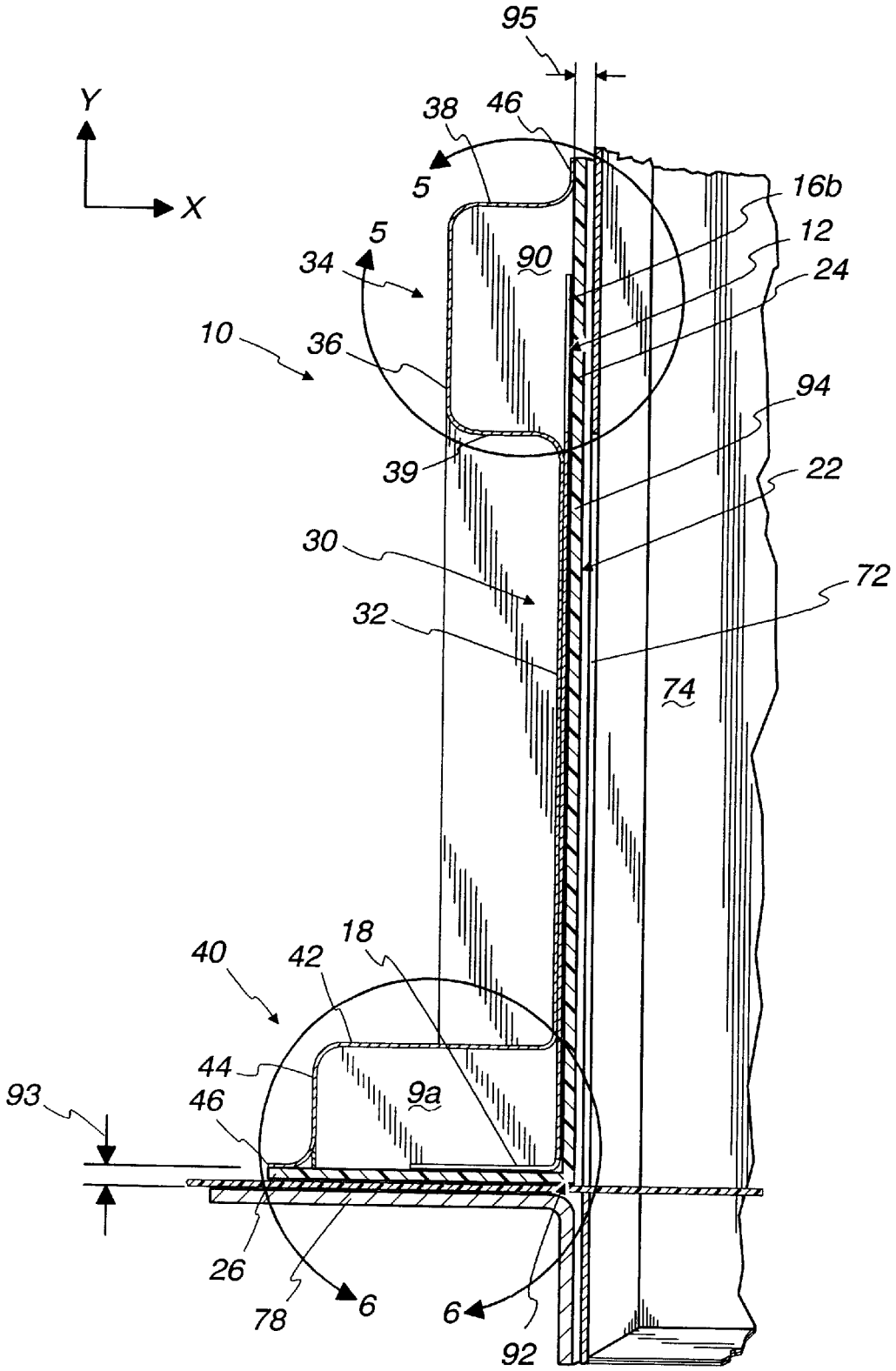
FIG. 4 is a side view of the electromagnetic choke incorporated into the door of a microwave oven where one of the seams created by the door is perpendicular to the remainder of the seams.

FIGS. 3A and 3B are isometric views of a door assembly 60 which includes the choke assembly 10. The door assembly 60 is to be used on a microwave oven 62 and translates between a closed position (FIG. 3A) and an open position (FIG. 3B). The door assembly 60 includes a pair of posts 64*a* and 64*b* on either side of the microwave oven 62. The choke ring 30 includes a corresponding pair of guides 66*a* and 66*b* which slide along posts 64*a* and 64*b,* respectively. The sliding of the guides 66*a* and 66*b* on the posts 64*a* and 64*b* allows the choke assembly 10 to move from the opened position to the closed position through the use of a motor (not shown).

Figure 7A:
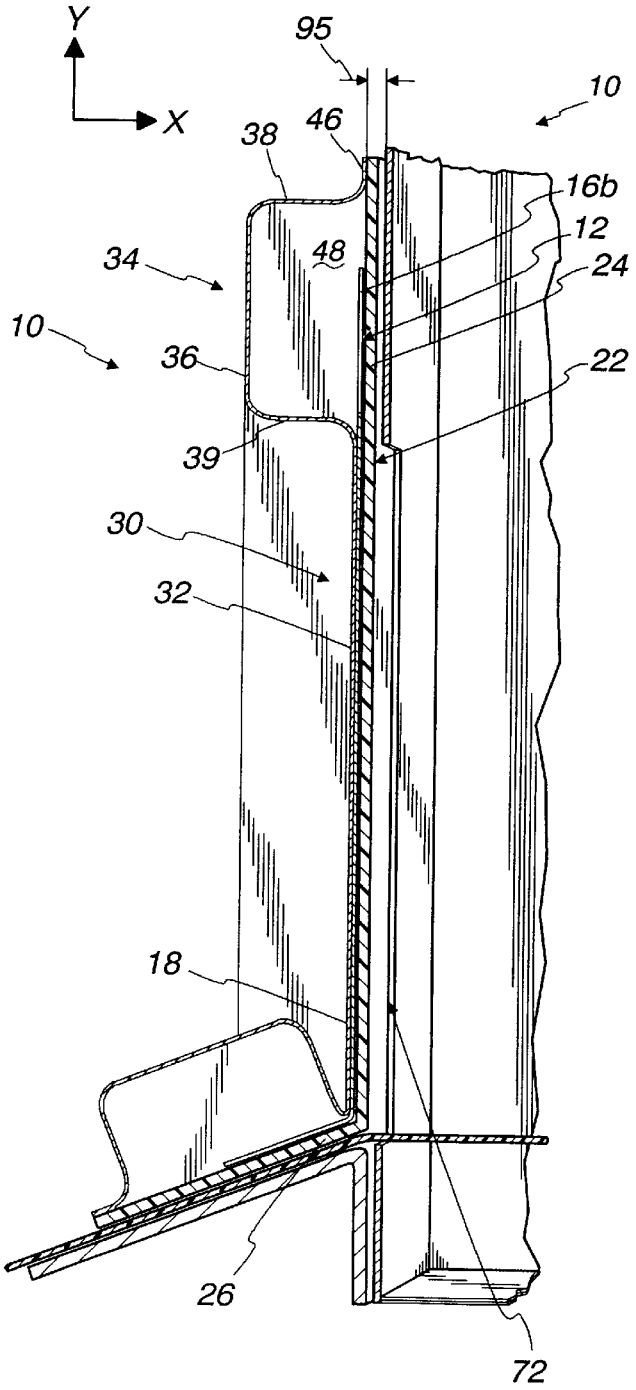
FIGS. 7A and 7B are a side and an isometric view, respectively, of the electromagnetic seal in a door assembly that also includes a housing for the electromagnetic seal.
Figure 7B:
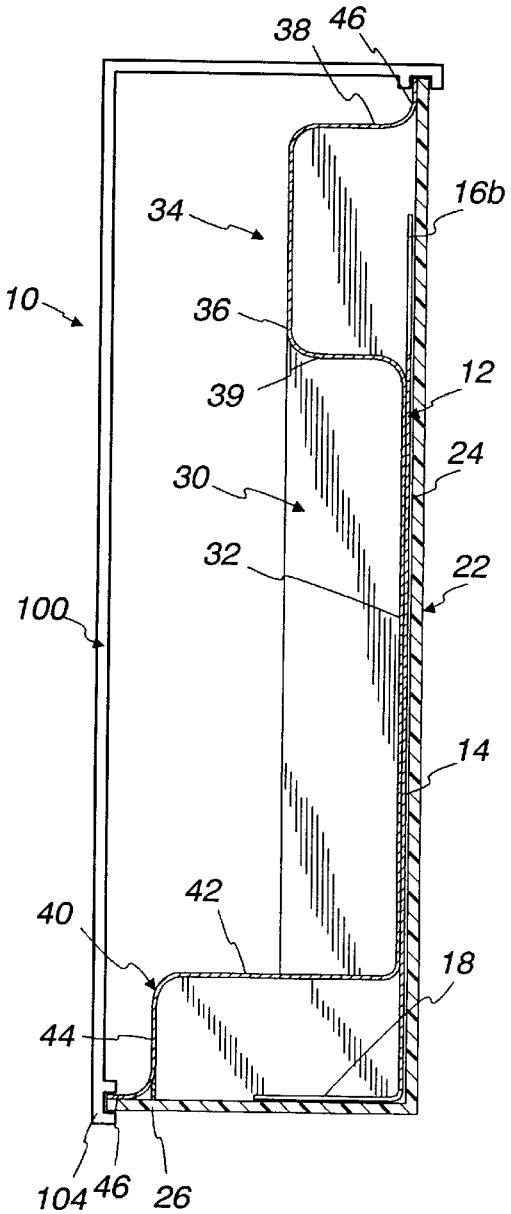
Figure 7B:
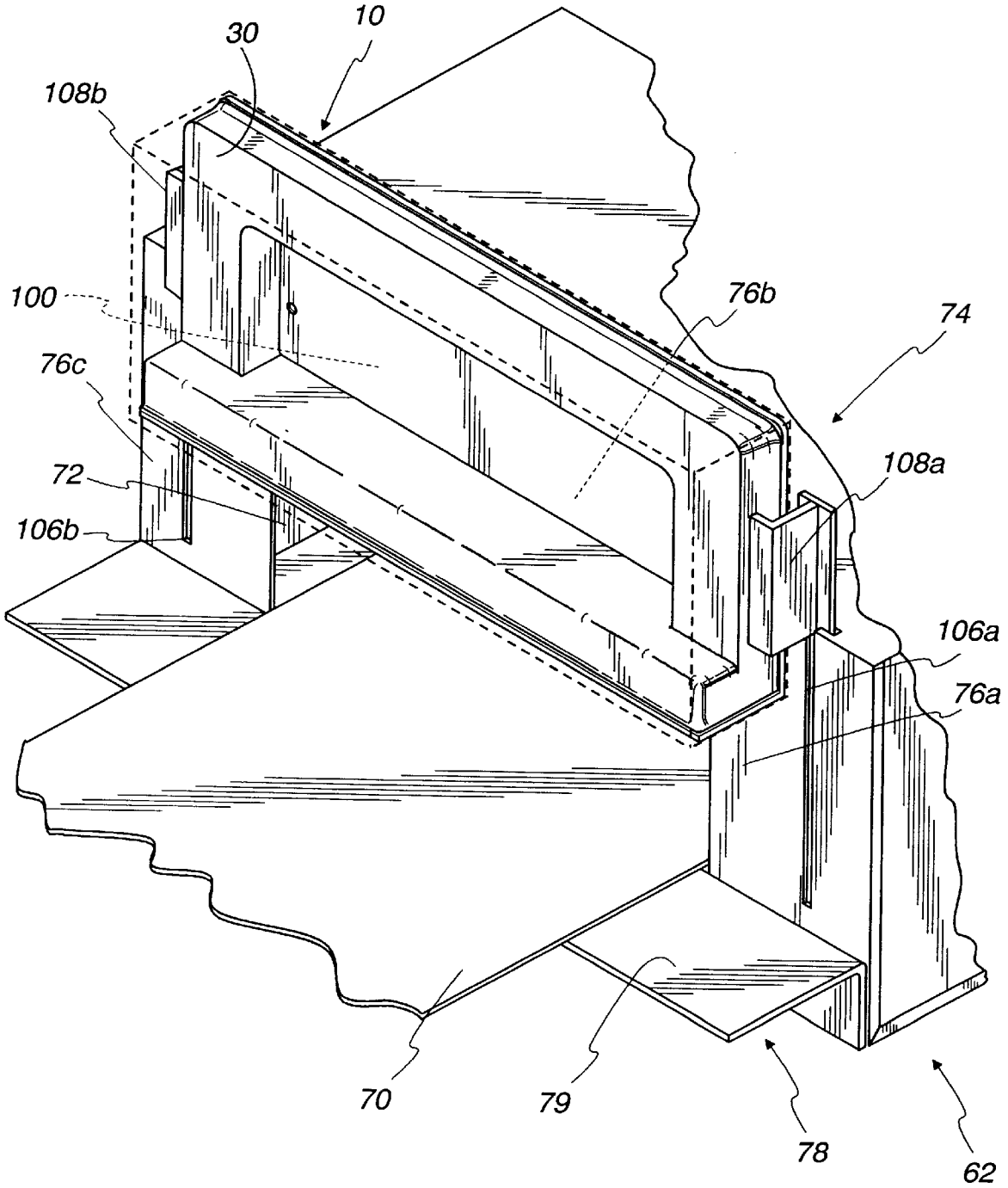

In an alternative embodiment, the posts 64 and guides 66 can be replaced with a slide mechanism which moves within a slot (see FIG. 7B). Thus, the choke ring 30 may have a slide mechanism and one of the peripheral surfaces adjacent to the opening 72 may have a slot in which the slide mechanism moves. In yet another alternative, one of the posts 64*a* and 64*b* can be replaced by a threaded rod which is rotatable. The choke ring 30 would have a nut that threadably engages the threaded rod. As the threaded rod is rotated, the entire choke assembly 10 would translate as the nut moves along the threaded rod.

The microwave oven 62 includes a conveyer belt 70 which transports an item 71 through an opening 72 into an internal cavity 74 of the oven 62 where the items are to be heated. The opening 72 to the internal cavity 74 is defined by three peripheral surfaces 76*a,* 76*b,* 76*c* which lie in a common plane. A lower flange 78 is attached to the oven 62 and has an upper surface 79 that is in a plane that is orthogonal to the plane wherein the peripheral surfaces 76*a,* 76*b,* and 76*c* lie. The upper surface 79 can be considered a peripheral surface in that it also defines the opening 72 to the internal cavity 74. The lower flange 78 can be welded to the exterior surface of the oven 62 or can be held there by common fasteners.

When the door assembly 60 is opened, the conveyer belt 70 moves the item 71 into the internal cavity 74. The door assembly 60 is then moved to the closed position and the oven 62 begins operation to heat the item 71. Thus, the oven 62 is generally never operated without the door assembly 60 covering the opening 72 to the internal cavity 74.

FIG. 3A also illustrates the asymmetrical geometry that exists around the corner tabs 20 and those tabs within the sets of tabs 16*a* and 16*c* directly adjacent to the corner tabs 20. When moving downwardly along the sets of tabs 16*a* and 16*c* away from tabs 16*b,* the front surface 36 of the main ring section 30 is at a constant distance from tabs 16*a* and 16*c*. However, there is a point where the front surface 36 terminates and the first and second walls 42 and 44 defining the orthogonal ring section 40 begin. This causes the distance from the tabs 16*a* and 16*c* to the nearest structure, second wall 44, which is positioned thereabove to increase. In other words, at some point along the tabs 16*a* and 16*c,* the geometry substantially changes without effecting the electromagnetic sealing capability of the choke assembly 10. In one embodiment, this geometric change occurs approximately at the mid point of the tabs that are members of sets 16*a* and 16*c* and that are immediately adjacent to corner tabs 20.

Figure 5:
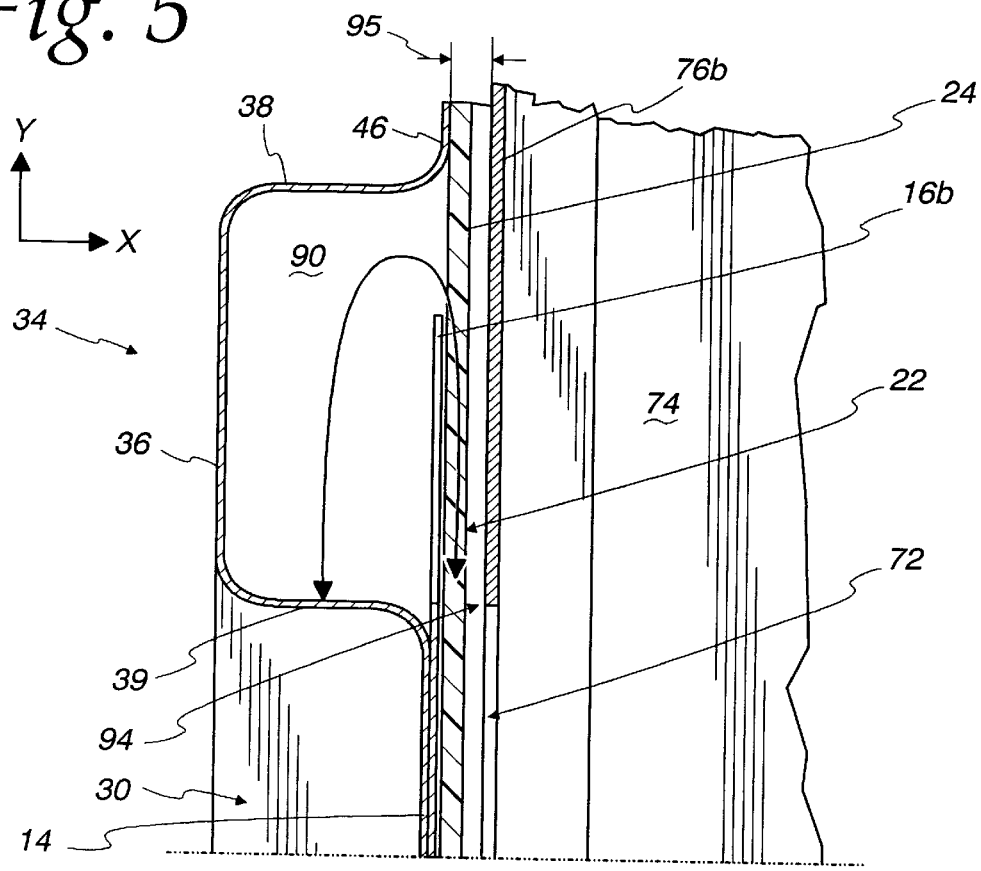
FIG. 5 is an expanded side-view of the electromagnetic choke from the region 5—5 in FIG. 4.
Figure 6:
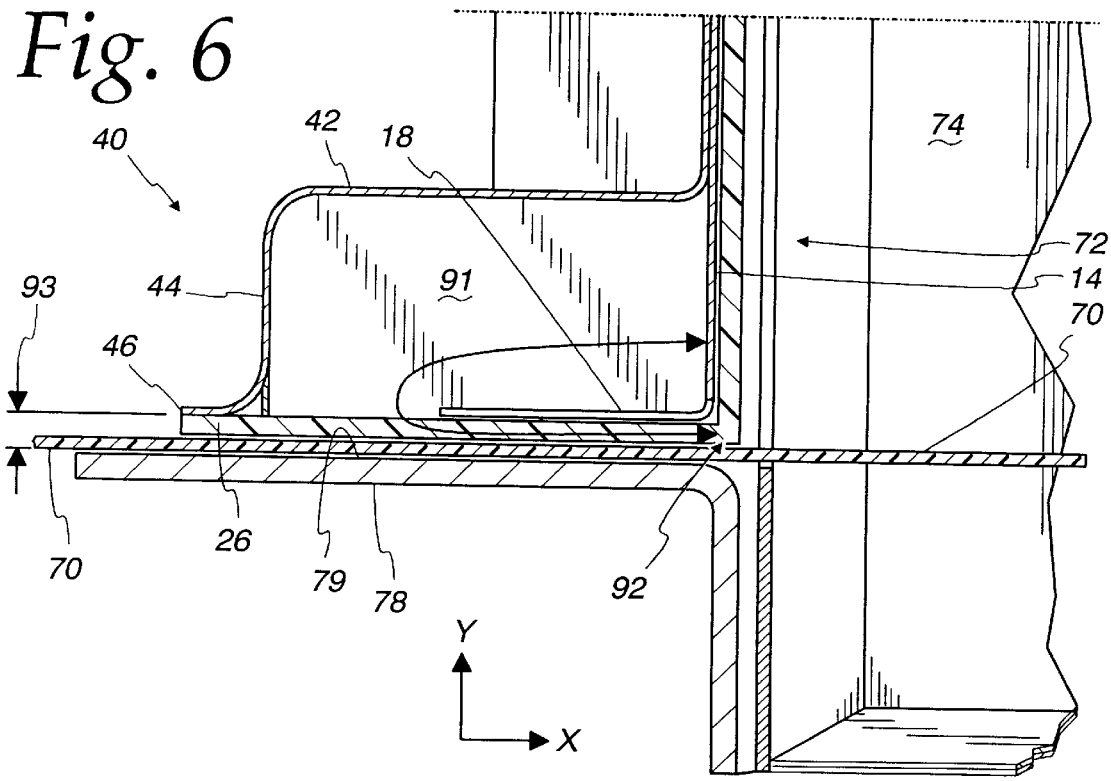
FIG. 6 is an expanded side-view of the electromagnetic choke from the region 6—6 in FIG. 4.

Referring now to FIG. 1, to FIG. 3A, to FIG 3B to FIG. 4 to FIG. 5, and to FIG. 6, the sealing of the oven 62 is brought about by the geometry of the choke panel 12, the choke ring 30, the peripheral surfaces 76*a,* 76*b,* and 76*c,* and the upper surface 79 of the flange 78. A choke cavity 90 is defined by the main ring section 34, the peripheral surface 76*b,* and the set of tabs 16*b* of the choke panel 12. An orthogonal choke cavity 91 is defined by the orthogonal ring section 40, the top surface 79 of the flange 78, and the set of orthogonal tabs 18. It is the geometry of the choke cavity 90 and the orthogonal choke cavity 91 that suppresses one directional component of the electromagnetic energy while reflecting another directional component of the electromagnetic energy. Specifically with regard to the suppression of one directional component of the energy, it is the dimensions of the tabs 16, 18 and tab spaces 17, 19 that determine the effectiveness of the suppression. And, specifically with regard to the reflection of one component of the energy, it is the dimensional characteristics of the structure (i.e. choke ring, peripheral surface, etc.) defining each choke cavity 90 and 91 that dictate the effectiveness of the reflection. Reference to FIGS. 5 and 6 is helpful in explaining these energy suppression and reflection characteristics of the choke assembly 10.

In FIG. 5, the choke cavity 90 and the structures which define it are shown in an expanded view. A choke opening 94 to the choke cavity 90 is near, and, preferably, immediately adjacent to the edge of the base portion 14 of the choke panel 12 where the set of tabs 16*b* extend outwardly therefrom. Moving in the Y-direction with respect to the choke opening 94, a first energy path is present between the set of tabs 16*b* and the peripheral wall 76*b*. Note that the choke cover 22 is made of a material that is transparent to electromagnetic energy and thus is part of this first energy path. The first energy path terminates adjacent to the outer side wall 38 of the main ring section 34.

A second energy path is present between the tabs 16*b* and the front wall 36 of the main ring section 34. This second energy path extends from the outer side wall 38 of the main ring section 34 to the inner side wall 39 of the main ring section 34. In essence, the first and second energy paths within the choke cavity 90 are separated from one another by the tabs 16*b*. A transition area between the first and second energy paths is located between the tips of the tabs 16*b* and the outer side wall 38. Here, the energy is guided, or transitions, from one path into the other path.

Electromagnetic energy leaving the internal cavity 74 of the oven and propagating in the Y-direction first travels through the first energy path. Instead of leaving the oven through a seam 95 adjacent the choke ring flange 46, the energy is guided through the transition area into the second energy path. This is due to the fact that the energy will travel along the path of least resistance such that entering transition area is less resistance than exiting through the seam 95 since the seam 95 has a smaller area. Preferably, the transition area is substantially larger than the area of the seam 95. The energy travels along the second energy path toward the inner side wall 39. When the energy reaches the inner side wall 39, it is reflected therefrom and is sent back in the reverse direction initially along the second path and then along the first path toward choke opening 94. This is the reason the double-arrow line is shown in the choke cavity 90. Accordingly, choke opening 94 should also be thought of as a choke exit as well since the energy propagating in the Y-direction not only enters the choke cavity 90 through the choke opening 94, but it also exits from the choke cavity 90 through choke opening 94 after being reflected off the inner side wall 39.

However, it has been observed that energy propagates also in the Z-direction of the choke cavity 90 in FIG. 5 which can result in substantial electromagnetic leakage. This energy may be propagating in a different mode and at a different wavelength than the energy propagating in the Y-direction. The dimensions of the set of tabs 16*b* and spaces 17 (FIG. 1) determine the effectiveness of the suppression of the electromagnetic energy propagating in the Z-direction. In other words, the physical structure of the set of tabs 16 inhibits the propagation of energy in the Z-direction.

The length of the tabs (Y-direction in FIG. 5, X-direction in FIG. 6) is preferably less than one-quarter of a wavelength at the operating frequency. This is due to the fact that it is preferable for the path of energy propagating in the Y-direction to travel a distance equal to one-half of its operating wavelength so that the overall energy path resembles a short circuit. In other words, it is a standing wave with a node positioned at the choke opening 94. If the energy is to travel a distance equal to one-half of its wavelength, then it must travel one-quarter of the wavelength along each of the first and second energy paths since they are substantially the same length. Thus, the tabs must have a length less than one-quarter of a wavelength. And, the choke opening 94 is preferably immediately adjacent the reflective surface. Otherwise, the energy propagating in the Y-direction would be forced to travel a distance greater than one-quarter of its wavelength and, thus, the overall path length will be larger than one-half of the operating wavelength.

To attenuate the electromagnetic energy propagation in the Z-direction, it is necessary for the distances between the tab spaces (i.e. the width of the tabs) to be less than one wavelength and, preferably, be less than one-half of the operating wavelength. The width of the tab spaces is preferably small enough not to cause direct coupling of the energy between the first and second energy paths that is traveling in the Y-direction. But, it must be large enough to have an impact on the propagation of energy in the Z-direction.

In one preferred embodiment a commercial microwave oven operates at 2.45 GHz (i.e. about 12 cm wavelength) and has an opening 72 with a height of 4 inches and a width of 9 inches. The choke panel 12 is formed from 0.030 inch aluminum stock. The width of tabs (Z-direction) is chosen to be 0.5 inch. The spaces between the tabs (Z-direction) are about 0.1 inch. Lastly, the tabs have a length that is less than 1 inch and, preferably, about 0.9 inches.

With regard to the dimensions of the main choke ring 40, the inner side wall 39 and, therefore, the choke opening 94 is separated from the outer side wall 38 by 1.2 inch (about 3 cm) which is one-quarter of the operating wavelength. Thus, the roundtrip distance of travel for energy propagating in the Y-direction in FIG. 5 is 2.4 inches (about 6 cm) which is one-half the operational wavelength. The front surface 36 is spaced from the peripheral surface 76*b* by 0.6 inch. The transition area has a length of 0.3 inch between the tip of the tabs 16*b* and the outer side wall 38. When the tabs and the main choke ring 40 have these dimensions, the leakage from seam 95 is at acceptable levels.

With reference to FIG. 6, the same concepts described above with reference to FIG. 5 also hold true. A choke cavity opening 92 allows energy from the internal cavity 74 of the oven to enter the orthogonal choke cavity 91. Unlike FIG. 5, the Y-component of the energy entering the choke opening 92 is minimal. However, the X-component of the energy entering opening 92 is substantial relative to the X-component of energy entering the choke opening 94 in FIG. 5. Energy directed in the X-direction that enters choke opening 92 travels along a first energy path defined between the upper surface 79 of the flange 78 and the tabs 18 in a direction toward the second wall 44 of the orthogonal ring section 40. The energy then propagates along a second energy path defined between the tabs 18 and the first wall 42 of the orthogonal choke ring 40. The energy then reflects off the lower region of the base portion 14 of the choke panel 12 and returns along the second energy path, the first energy path, and eventually into the cavity 74 through opening 92. The base portion 14 of the choke panel is a reflective surface like side wall 39 in FIG. 5. And, like choke opening 94 of FIG. 5, the choke opening 92 is actually an exit as well as an entrance.

The area between the tips of the tabs 18 and the second wall 44 is a transition area through which energy transitions between the first energy path and the second energy path. This transition area presents a less resistive path than seam 93 which leads to the exterior of the oven. Thus, the energy remains within the choke cavity 91 rather than exiting through seam 93. It should be noted that the seam 93 also includes the conveyer 70.

With regard to suppressing energy that is propagating in the Z-direction, the tabs 18 have the same dimensional characteristics as the tabs 16 described above. Thus, energy propagating in the Z-direction in choke cavity 90 (FIG. 5) and choke cavity 91 (FIG. 6) is suppressed in substantially the same manner.

Concerning the reflection of energy, the base portion 14 of choke panel 12 is separated from the second wall 44 of the orthogonal choke ring 40 by a distance equal to one quarter of the operating wavelength. Thus, on an oven operating at 2.45 GHz, this distance is again about 1.2 inches. The first wall 42 is displaced from the flange 78 by about 0.6 inch.

The dimensions of the seams 95 and 93 are typically less than about 0.2 inch and should always be less than the transition area defined between the first and second energy paths. In one embodiment, the thickness of the choke cover 22 is about 0.06 inch. Thus, the main segment 24 (FIG. 5) and the orthogonal segment 26 (FIG. 6) of the choke cover 22 provide a portion of the space creating seams 95 and 93, respectively. The air gap between main segment 24 and the peripheral wall 76*a* is about 0.02 inch making the overall seam 95 have a dimension of about 0.08 inch. The conveyer 70 in FIG. 6 (e.g. made of fiberglass) has a thickness of about 0.025 inch. Thus, seam 93 has a dimension of about 0.085 inch.

It should also be noted that the choke assembly 10 affects the energy adjacent to peripheral walls 76*a* and 76*c* (FIGS. 3A and 3B) in the same manner as described with regard to FIG. 5 as each of these peripheral walls 76*a* and 76*c* also have a main ring segment 34 with a C-shaped cross section. However, if using the coordinate system of FIGS. 5 and 6, the energy that is suppressed in the choke cavities adjacent peripheral walls 76*a* and 76*c* is propagating in the Y-direction in that it is attempting to circulate around the opening 72. And, the energy being reflected off the inner side wall 39 of the choke cavities adjacent peripheral walls 76*a* and 76*c* and sent back into the internal cavity 74 of the oven is propagating in the Z-direction. In this regard, the choke assembly 10 reflects three different components of the energy. The Z-direction component is reflected near peripheral walls 76*a* and 76*c*. The X-direction component is reflected near the flange 78. And, the Y-direction component is reflected near peripheral wall 76*b*.

FIGS. 7A and 7B illustrate the choke assembly 10 described with reference to FIGS. 1–6 and a housing 100 coupled thereto. In FIG. 7B, the housing 100 is illustrated in dashed lines to reveal the choke assembly 10 thereunder. The housing 100 has little, if any, effect on the overall electromagnetic shielding of the choke assembly 10 and is primarily used for aesthetic purposes. However, the housing may serve some functional purposes. For example, the housing 100 includes a first clip structure 102 that acts to hold the main segment 24 of the choke cover 22 to the choke ring flange 46 of the choke ring 30 as is shown in FIG. 7A. Furthermore, a second clip structure 104 holds the orthogonal segment 24 of the choke cover 22 to the lower region of the choke ring flange 46. Thus, the housing 100 may be used to hold the choke cover 22 to the choke ring 30 and choke panel 12.

If the housing 100 includes these clip structures 102 and 104, then the seams 93 (FIG. 6) and 95 (FIG. 5) will increase in their dimensions. For example, the clip structures 102 and 104 may add an additional 0.02 inch to the dimension of the seams 93 and 95. However, the choke assembly 10 still is effective in sealing the oven with these larger seams.

Furthermore, the housing 100 may include the structure that allows for the vertical sliding of the choke assembly 10 into its operational position. In FIG. 7B, the oven 62 includes on its peripheral surfaces 76*a* and 76*c* a pair of slots 106*a* and 106*b*.

The housing 100 includes sliding mechanisms 108*a* and 108*b* that fit and slide within the slots 106*a* and 106*b*, respectively. Thus, a motor (not shown) can move the housing 100 and the choke assembly 10 from an opened to a closed position.

In a further alternative to the vertical sliding of the choke assembly 10, the choke assembly 10 may simply pivot around hinges located on one of the peripheral surfaces 76*a*, 76*b*, and 76*c* to move from an open position to a closed position. The hinges would require this pivoting movement to occur with a small tolerance so as to not contact and obstruct the conveyer belt 70 while pivoting.

It should also be noted that the aforementioned electromagnetic sealing maybe enhanced by placing energy absorbing materials in strategic positions adjacent to, or even within, the seams. This absorbing material may further reduce the amount of leakage from the microwave oven. One example of a common absorbing material is a carbon-filled elastomer compound.

Figure 8:
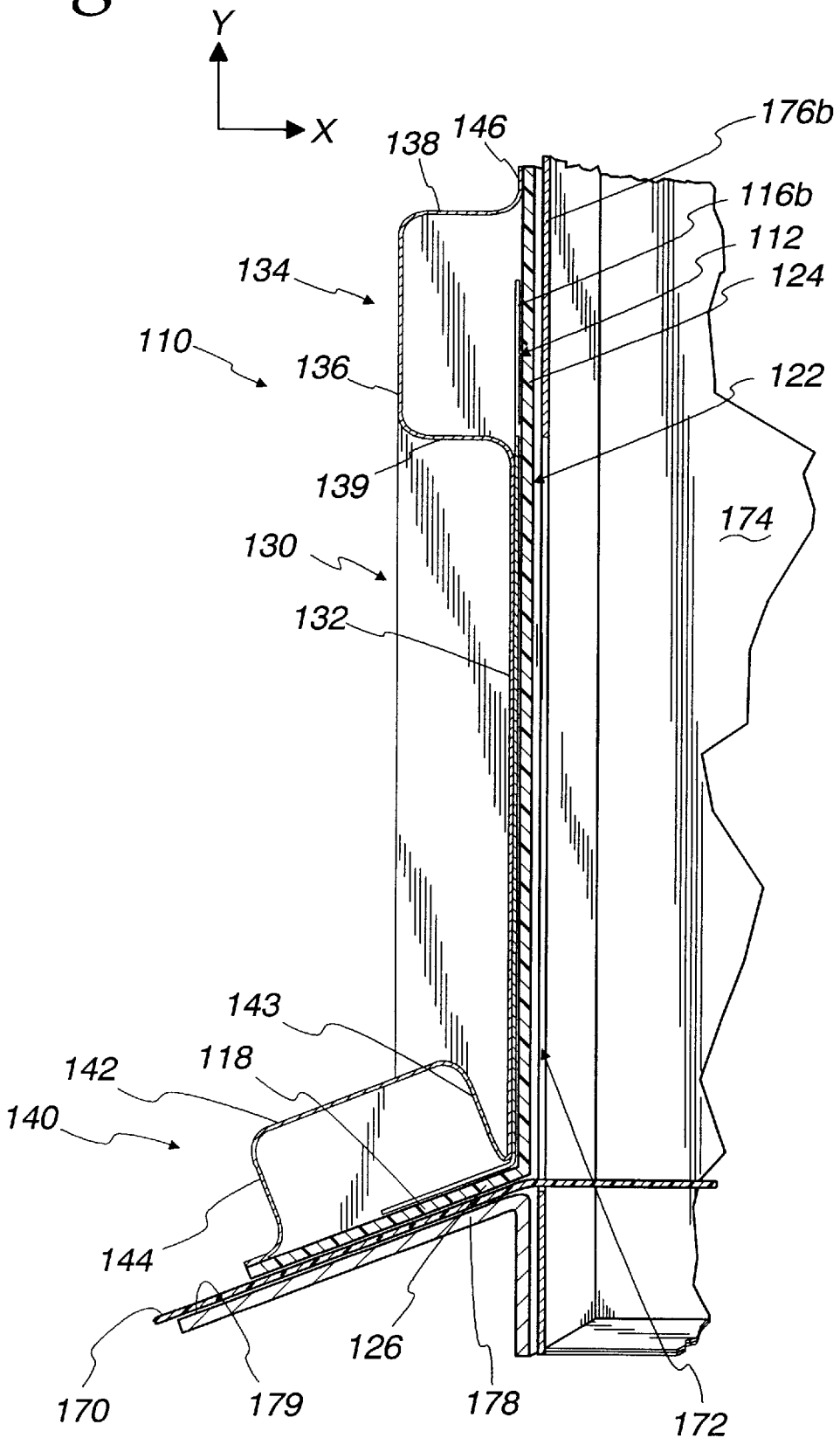
FIG. 8 is a side view of an alternative electromagnetic choke incorporated into a door of a microwave oven where one of the seams is at an angle with the remainder of the seams.

FIG. 8 reveals an alternative embodiment but includes the same reference numerals as previously discussed except the numerals of FIG. 8 are now shown in a 100 series. Unlike the previous embodiment, the conveyer 170 in FIG. 8 is entering the opening 172 of the internal cavity 174 of the oven at an angle. The main ring section 134 of the choke ring 130 is the same as discussed previously as it is defined by a front wall 136, an outer side wall 138, and an inner side wall 139.

The tabs 116*b* of the choke panel 112 are positioned between peripheral wall 176*b* and the main ring section 134. The main segment 124 of the choke cover 122 is positioned adjacent to the choke panel 112 and the tabs 116*b*.

The flange 178 and its upper surface 179 are angled downwardly. An angled ring section 140 includes a first wall 142 that is parallel to the upper surface 179 of the flange 178. The first wall 142 bridges a second wall 144 and a reflective surface 143. No structure corresponding to the reflective surface 143 exists in the orthogonal ring section 40 in the previous embodiments. Thus, as the energy enters the choke cavity defined by the flange 178, the angled ring section 140, and the tabs 118, the energy is reflected off the reflective surface 143 and returned into the internal cavity 174 of the oven. Energy propagating in the Z-direction is suppressed due to the tabs 118.

Other aspects of the microwave oven employing the present invention are disclosed in copending U.S. Patent Application entitled "A Rethermalization Pass Through Oven System" by Larry Engebritson, Richard Edgar, Mary Jo Heitzman, J. Scott Petty, and Nelson Ferragut, filed Sep. 8, 1997, assigned to Amana Corporation (Attorney Docket No. AMNA:012), which is hereby incorporated by reference in its entirety.

Each of these embodiments and obvious variations thereof is contemplated as falling within the spirit and scope of the invention, which is set forth in the following claims.

What is claimed is:

1. An electromagnetic seal for an oven that heats items through the use of microwave energy, said oven having a cavity in which said items are to be placed and a rectangular opening leading to said cavity, said oven including peripheral surfaces surrounding said opening to said cavity, one of said peripheral surfaces being orthogonal to the other peripheral surfaces, said electromagnetic seal comprising:

a choke panel having a generally rectangular base portion with four edges and a set of tabs extending from each of said four edges, a first set of tabs is generally parallel to said orthogonal one of said peripheral surfaces, each of said remaining three sets of tabs is generally parallel to a corresponding one of said other peripheral surfaces;

a choke ring circumscribing said four edges of said base portion and is electrically connected to said choke panel, said sets of tabs are positioned between said choke ring and said peripheral surfaces; and a choke cavity adjacent to each of said peripheral surfaces for reflecting one directional component of said microwave energy and for suppressing another directional component of said microwave energy, each of said choke cavities is defined by said choke panel, said choke ring, and said adjacent peripheral surface, said choke cavity adjacent to said orthogonal peripheral surface reflects said microwave energy from a region of said base portion of said choke panel, said choke cavities adjacent to said other peripheral surfaces reflect said microwave energy from said choke ring, each of said choke cavities has a first energy path defined by said adjacent peripheral surface and said choke panel and a second energy path defined by said choke panel and said choke ring.

2. The electromagnetic seal of claim 1, further comprising a choke cover coupled to said choke panel and said choke ring, said choke cover having a first segment that is parallel with said first set of tabs and a second segment that is parallel with said remaining three sets of tabs, a combination of said choke cover and said choke ring substantially encloses said sets of tabs.

3. The electromagnetic seal of claim 2, wherein said choke cover is made entirely of a material that is transparent to said microwave energy.

4. The electromagnetic seal of claim 1, wherein said choke ring includes a middle section substantially parallel to and aligned with said base portion of said choke panel, said middle section providing said electrical connection of said choke ring to said choke panel.

5. The electromagnetic seal of claim 1, wherein said base portion of said choke panel is perforated with holes and said choke ring has a middle section made of an optically transparent material so as to allow viewing of said oven cavity.

6. The electromagnetic seal of claim 1, wherein said choke ring includes a surface opposing each reflective surface from which said energy reflects, said opposing surface and said reflective surface being separated by distance approximately equal to one-quarter of the wavelength of said microwave energy at its operating frequency.

7. The electromagnetic seal of claim 6, wherein each of said choke cavities has a seam leading to an exterior of said oven, said seam being adjacent to said opposing surface.

8. The electromagnetic seal of claim 7, wherein said energy transitions between said first and second energy paths through a transition area, said transition area being substantially larger than said seam.

9. The electromagnetic seal of claim 1, wherein said choke ring has a C-shape cross-section in regions adjacent to said other peripheral surfaces, said C-shape cross-section of said choke ring is defined by an inner side wall, an outer side wall opposing said inner side wall, and a front wall bridging said inner and outer side walls, said inner side wall providing a reflective surface from which said electromagnetic energy is reflected.

10. The electromagnetic seal of claim 9, wherein said inner side wall is separated from said outer side wall by a distance approximately equal to one-quarter of the wavelength of said energy at its operating frequency.

11. The electromagnetic seal of claim 1, wherein each of said four edges of said base portion of said choke panel from which said tabs extend is directly adjacent to a surface reflecting said microwave energy.

12. The electromagnetic seal of claim 1, wherein each of said four edges from which said tabs extend is near an edge of said opening to said internal cavity of said oven.

13. The electromagnetic seal of claim 1, wherein said choke ring has an L-shape cross-section in the region adjacent to said orthogonal peripheral surface, said L-shape cross-section of said choke ring is defined by a first wall perpendicular to said base portion of said choke panel and a second wall opposing a reflective surface on said base portion from which said energy is reflected.

14. The electromagnetic seal of claim 1, wherein the summation of the lengths of said first and second energy paths is approximately equal to one-half of the wavelength of said microwave energy at its operating frequency.

15. An electromagnetic seal for an oven that heats items through the use of microwave energy, said oven having a cavity in which said items are to be placed, an opening leading to said cavity lying in a first plane, and peripheral surfaces surrounding said opening to said cavity, one of said peripheral surfaces is at an angle relative to said first plane, the other peripheral surfaces are substantially within said first plane, said electromagnetic seal comprising:

a choke panel generally parallel to and spaced from said first plane, said choke panel having a plurality of edges;

a set of tabs attached to each of said plurality of edges of said choke panel, one of said sets of tabs is generally parallel with and adjacent to said angled one of said peripheral surfaces, each of the remaining sets of tabs is generally parallel with and adjacent to one of said other peripheral surfaces;

a choke ring connected to said choke panel, said choke ring having an orthogonal ring section adjacent to said orthogonal peripheral surfaces and a main ring section adjacent to said other peripheral surfaces; and a choke cavity adjacent to each of said peripheral surfaces for reflecting one directional component of said microwave energy and for suppressing another directional component of said microwave energy, each of said choke cavities having a first energy path defined by said adjacent peripheral surface and said choke panel, and a second energy path defined by said choke panel and said choke ring, said choke cavities reflecting three different directional components of said microwave energy.

16. The electromagnetic seal of claim 15, wherein the summation of the lengths of said first and second energy paths is approximately equal to one-half of the wavelength of said microwave energy at its operating frequency.

17. The electromagnetic seal of claim 15, wherein said angle is 90°.

18. The electromagnetic seal of claim 15, wherein said choke panel includes a reflective surface from which said microwave energy is reflected in said choke cavity adjacent to said orthogonal peripheral surface.

19. The electromagnetic seal of claim 15, further comprising a choke cover connected to said choke panel and said choke ring, said choke cover having a first segment that is parallel with said first set of tabs and a second segment that is parallel with said remaining three sets of tabs, a combination of said choke cover and said choke ring substantially enclosing said sets of tabs.

20. The electromagnetic seal of claim 15, wherein said choke ring includes a surface opposing each reflective surface from which said microwave energy is reflected, said opposing surface and said reflective surface being separated by distance approximately equal to one-quarter of the wavelength of said microwave energy at its operating frequency.

21. The electromagnetic seal of claim 20, wherein each of said choke cavities has a seam leading to an exterior of said oven, said seam being adjacent to said opposing surface.

22. The electromagnetic seal of claim 21, wherein said microwave energy transitions between said first and second energy paths through a transition area, said transition area is substantially larger than said seam.

23. The electromagnetic seal of claim 15, wherein each of said four edges of said base portion of said choke panel from which said tabs extend directly adjacent to a surface reflecting said microwave energy.

24. A microwave oven that heats items through the use of microwave energy, comprising:

a housing structure defining a cavity in which said items are to be placed and an opening to said oven cavity, said housing structure including peripheral surfaces surrounding said opening to said cavity, one of said peripheral surfaces being orthogonal to the other peripheral surfaces;

a microwave energy source for producing microwave energy in said oven cavity for heating said items;

a door capable of moving between an open position in which said opening to said oven cavity is accessible and a closed position in which said opening is inaccessible, said door including a choke panel, a choke ring connected to said choke panel, and a choke cavity adjacent to each of said peripheral surfaces for reflecting one directional component of said microwave energy and for suppressing another directional component of said microwave energy, said choke panel having a base portion and a plurality of tabs extending from said base portion, said plurality of tabs including a first set of tabs that is orthogonal to the remaining ones of said plurality of tabs and generally parallel to said orthogonal peripheral surface when said door is in said closed position, said choke ring has an orthogonal ring section adjacent to said orthogonal peripheral surface and a main ring section adjacent to said other peripheral surfaces, each of said choke cavities having a first energy path defined by said adjacent peripheral surface and said choke panel and a second energy path defined by said choke panel and said choke ring, said choke cavities reflecting three different directional components of said microwave energy; and means for moving said door between said open position and said closed position.

25. The microwave oven of claim 24, wherein said door moving means includes a hinge mounted to said choke ring, said door being rotatable around said hinge.

26. The microwave oven of claim 24, wherein said door moving means includes at least one post fixed on said housing structure and at least one guide fixed to said door for slidably mating with said at least one post.

27. The microwave oven of claim 24, wherein said door further comprises a choke cover that has a first segment parallel to and disposed away from said orthogonal peripheral surface and a second segment parallel to and disposed away from said other peripheral surfaces, said choke cover being connected to said choke ring.

28. The microwave oven of claim 24, wherein said moving means includes a slot disposed in at least one of said peripheral walls and a sliding mechanism coupled to said door for mating with and sliding within said at least one slot.

29. The microwave oven of claim 24, wherein said door further comprises a door housing fitting over said choke ring and said choke panel.

30. The microwave oven of claim 29, wherein at least one component of said moving means is disposed on said door housing.

31. The microwave oven of claim 30, wherein said at least one component of said moving means is a sliding mechanism.

32. The microwave oven of claim 24, wherein said door further comprises a choke cover and a door housing, said choke cover having a first segment parallel to and disposed away from said orthogonal peripheral surface and a second segment parallel to and disposed away from said other peripheral surfaces, said door housing fitting over said choke ring and having a clip structure retaining said choke cover to said choke ring.

33. The microwave oven of claim 24, wherein said choke panel provides a reflective surface for reflecting said microwave energy in said choke cavity adjacent to said orthogonal peripheral surface.

34. The microwave oven of claim 24, wherein the summation of the lengths of said first and second energy paths is approximately equal to one-half of the wavelength of said microwave energy at its operating frequency.

35. The microwave oven of claim 24, wherein said choke ring includes reflective surfaces for reflecting said microwave energy in said choke cavities adjacent to said other peripheral surfaces.

36. The microwave oven of claim 24, wherein said choke ring includes a surface opposing each reflective surface that reflects said microwave energy, said opposing surface and said reflective surface being separated by distance approximately equal to one-quarter of the wavelength of said microwave energy at its operating frequency.

37. The microwave oven of claim 24, further comprising a conveyer belt for delivering said items to said oven cavity, said conveyer belt being between said orthogonal peripheral surface and said first set of tabs when said door is in said closed position.

38. The microwave oven of claim 37, wherein said door moving means provides for movement of said door in a direction perpendicular to said conveyer belt.

* * * * *